US005906126A

United States Patent [19]

Chiu

[11] Patent Number: 5,906,126

[45] Date of Patent: May 25, 1999

[54] ANGLE ADJUSTING DEVICE OF STEEL BAR BENDING APPARATUS

[76] Inventor: Wen-Chung Chiu, No. 43, TungYuan Rd., ChungLi City, TaoYuan Hsien, Taiwan

[21] Appl. No.: 09/064,220

[22] Filed: Apr. 22, 1998

[51] Int. Cl.[6] ..... B21B 37/00

[52] U.S. Cl. ..... 72/21.3; 72/31.05; 72/31.12

[58] Field of Search ..... 72/20.1, 20.2, 72/21.3, 31.01, 31.04, 31.05, 31.1, 31.11, 31.12, 217, 218, 219

[56] References Cited

U.S. PATENT DOCUMENTS

| | | | |
|---|---|---|---|
| 3,393,543 | 7/1968 | Van Gelder | 72/21.3 |
| 3,512,383 | 5/1970 | Arnold et al. | 72/20.2 |
| 4,223,543 | 9/1980 | Sakamoto | 72/217 |
| 5,203,192 | 4/1993 | Kimura | 72/21.3 |

*Primary Examiner*—Joseph J. Hail, III
*Assistant Examiner*—Ed Tolan
*Attorney, Agent, or Firm*—Bacon & Thomas, PLLC

[57] ABSTRACT

An angle adjusting device of a steel bar bending apparatus includes at least an adjusting unit, having a casing inside which a worm and worm gear pair is disposed. The worm is rotatably fit over a shaft which is in turn rotatably supported within the casing. The shaft is driven by a driving motor of the steel bar bending apparatus. The worm is fixed on a spindle having an end extending outside the casing to which a rotation knob is releasably fixed for rotating the worm about a central axis of the shaft. A switch is attached to the worm so that the angular position thereof about the central axis is adjustable by rotating the knob. A triggering member is fixed on the shaft so that when the shaft is driven by the motor to reach and thus trigger the switch, the motor is turned off by the operation of the switch. The casing is provided with a top projection and a corresponding bottom recess for receiving and fixing the top projection of a second unit for stacking the units over each other. The shaft is provided with an upper end projection and a lower end recess for drivingly coupling the shafts of the units together.

19 Claims, 5 Drawing Sheets

ANGLE ADJUSTING DEVICE OF STEEL BAR BENDING APPARATUS

FIELD OF THE INVENTION

The present invention relates generally to a steel bending apparatus for bending steel bars particularly used in a construction site and in particular to an angle adjusting device to be adapted in a steel bar bending apparatus to provide a multiple angle adjustment for a more precision and more efficient operation of bending steel bars.

BACKGROUND OF THE INVENTION

Steel bar bending apparatus is commonly used in a construction site for bending steel bars in constructing a structure or a building. The general structure of the common steel bar bending apparatus comprises a fixed roller and a movable roller to provide a rolling contact with a steel bar to be bent and a fulcrum block adjacent the fixed roller, but having a space therebetween to allow the steel bar to extend therethrough. The movable roller is driven to bend one end of the steel bar about and fulcrum block, while the fixed roller serves to hold the opposite end of the steel bar. The movement of the movable roller is substantially circular with the center at the fulcrum block.

An early day steel bar bending apparatus may only perform bending operation of a predetermined angle and no adjustment of the bending angle is readily available. A later developed steel bending apparatus overcomes such a problem and allows a multiple angle bending operation. However, there is still a limitation on the number of the angles that may be achieved by the apparatus.

Furthermore, conventionally, the steel bar bending apparatus that provides a multiple angle adjustment is usually controlled by an IC-based controller which may easily malfunction, due to the severe environment of a construction site, causing incorrect angle of bending.

To overcome such a problem, a steel bar bending apparatus which comprises several bending units combined together to provide a multiple angle adjustment was taught. Such an apparatus, although being controlled in a mechanical way rather than an IC-based fashion, requires a large installation space and the combination of the bending units is quite time-consuming and difficult. In addition, the design of such an apparatus is an open style, in which the transmission and control elements, such as gear, worm, worm gear, are exposed to the severe environment of the construction site so that corrosion and aging problem may quick raise and thus causing imprecision of angle in bending a steel bar.

Such a steel bar bending apparatus also have other drawbacks, for example (1) it does not allow an arbitrary addition of bending units in forming different angle bends on the same steel bar, (2) the open style design makes it lack of an aesthetic appearance and (3) it has a poor fine adjustment of the bending angle.

Thus, it is desired to have an improved bending device to be incorporated in a steel bar bending apparatus which allows simple and ready combination of an arbitrary number of bending units to perform a multiple bending angle settings in an efficient and precision manner to as to substantially overcome the problems and drawbacks encountered in the prior art designs.

SUMMARY OF THE INVENTION

The principal object of the present invention is to provide an angle adjusting device which allows an arbitrary number of adjusting units to be readily combined together for the performance of a multiple angle bending operation of steel bar.

Another object of the present invention is to provide an angle adjusting device of a steel bar bending apparatus which has a substantially closed design so as to reduce the corrosion and aging problem caused by the severe environment of a construction site.

A further object of the present invention is to provide an angle adjusting device which allows manually setting the bending angle by a knob so as to achieve ready setting and fine adjustment.

Yet a farther object of the present invention is to provide an angle adjusting device of a steel bar bending apparatus which has a more aesthetical outer appearance.

Thus, in accordance with the present invention, there is provided an angle adjusting device adapted in a steel bar bending apparatus, comprises at least an adjusting unit, having a casing inside which a worm and worm gear pair is disposed. The worm is rotatably fit over a shaft which is in turn rotatably supported within the casing. The shaft is driven by a driving motor of the steel bar bending apparatus. The worm is fixed on a spindle having an end extending outside the casing to which a rotation knob is releasably fixed for rotating the worm about a central axis of the shaft. A switch is attached to the worm so that the angular position thereof about the central axis is adjustable by rotating the knob. A triggering member is fixed on the shaft so that when the shaft is driven by the motor to reach and thus trigger the switch, the motor is turned off by the operation of the switch. The casing is provided with a top projection and a corresponding bottom recess for receiving and fixing the top projection of a second unit for stacking the units over each other. The shaft is provided with an upper end projection and a lower end recess for drivingly coupling the shafts of the units together.

BRIEF DESCRIPTION OF THE DRAWINGS

The present invention will be better understood from the following description of a preferred embodiment thereof, with reference to the attached drawings, wherein.

DETAILED DESCRIPTION OF THE PREFERRED EMBODIMENT

Figure 1:
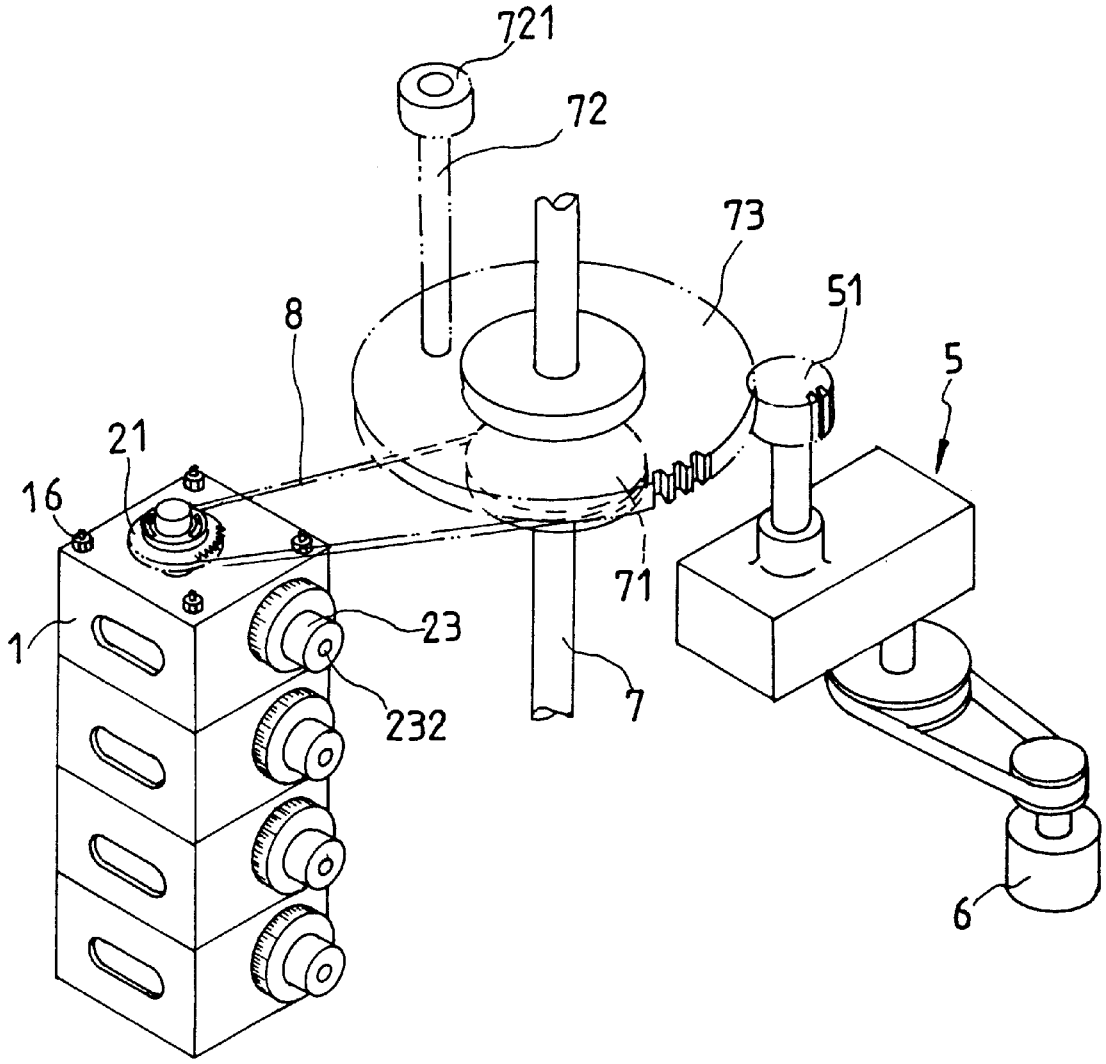
FIG. 1 is a perspective view showing a portion of a steel bar bending apparatus together with an angle adjusting device constructed in accordance with the present invention, wherein the angle adjusting device comprises four adjusting units stacking over each other.

With reference to the drawings and in particular to FIG. 1, wherein a portion of a steel bar bending apparatus together with an angle adjusting device constructed in accordance with the present invention is shown, the steel bar bending apparatus comprises a rotation source, such as a motor 6 which is coupled to a reduction gear set 5 to drive an output gear 51 of the reduction gear set 5. The output gear 51 of the reduction gear set 5 engages a gear 73 which is fixed to a shaft 7 so as to drive the shaft 7. An eccentric axle 72 is fixed on the gear 73 to orbit about the shaft 7 with a roller 721 fixed on top end of the axle 72 for performing bending operation. Such a structure is parts of a generally known steel bar bending apparatus and is known to those skilled in the art so that no f u rt her detail is needed.

The angle adjusting device in accordance with the present invention -comprises at least one adjusting unit 1, but it is preferably to have a plurality of such adjusting units 1 combined together to provide a multiple angle bending operation. In the embodiment illustrated in FIG. 1, there are four such adjusting units 1 stacked together. The uppermost one of the adjusting units 1 is coupled to the shaft 7 by means of for example a chain 8 and a sprocket 71 that is fixed on the shaft 7 to be driven thereby.

Figure 2:
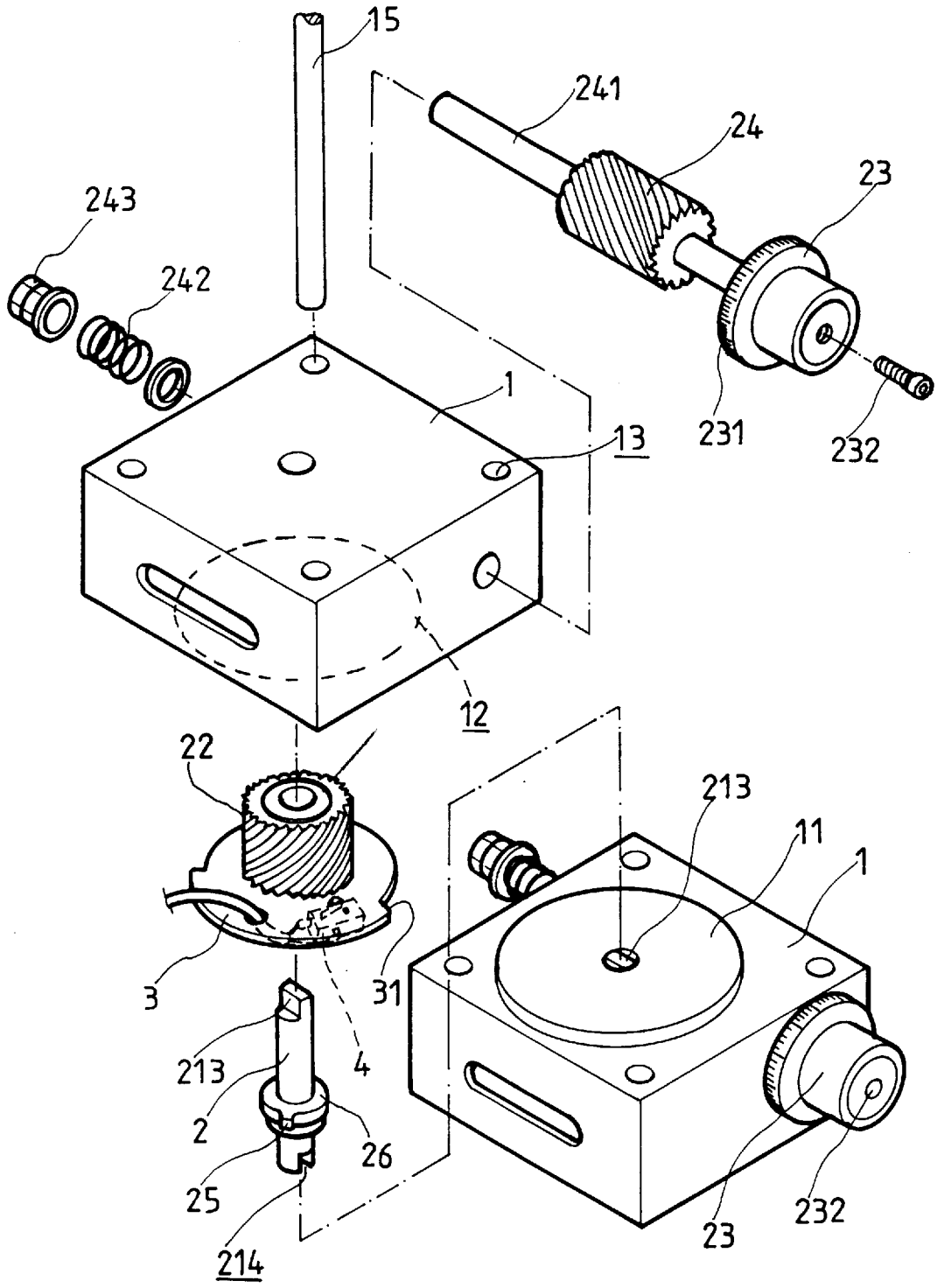
FIG. 2 is a exploded perspective view, showing two of the adjusting units to illustrate the inside details and the connection therebetween.
Figure 3:
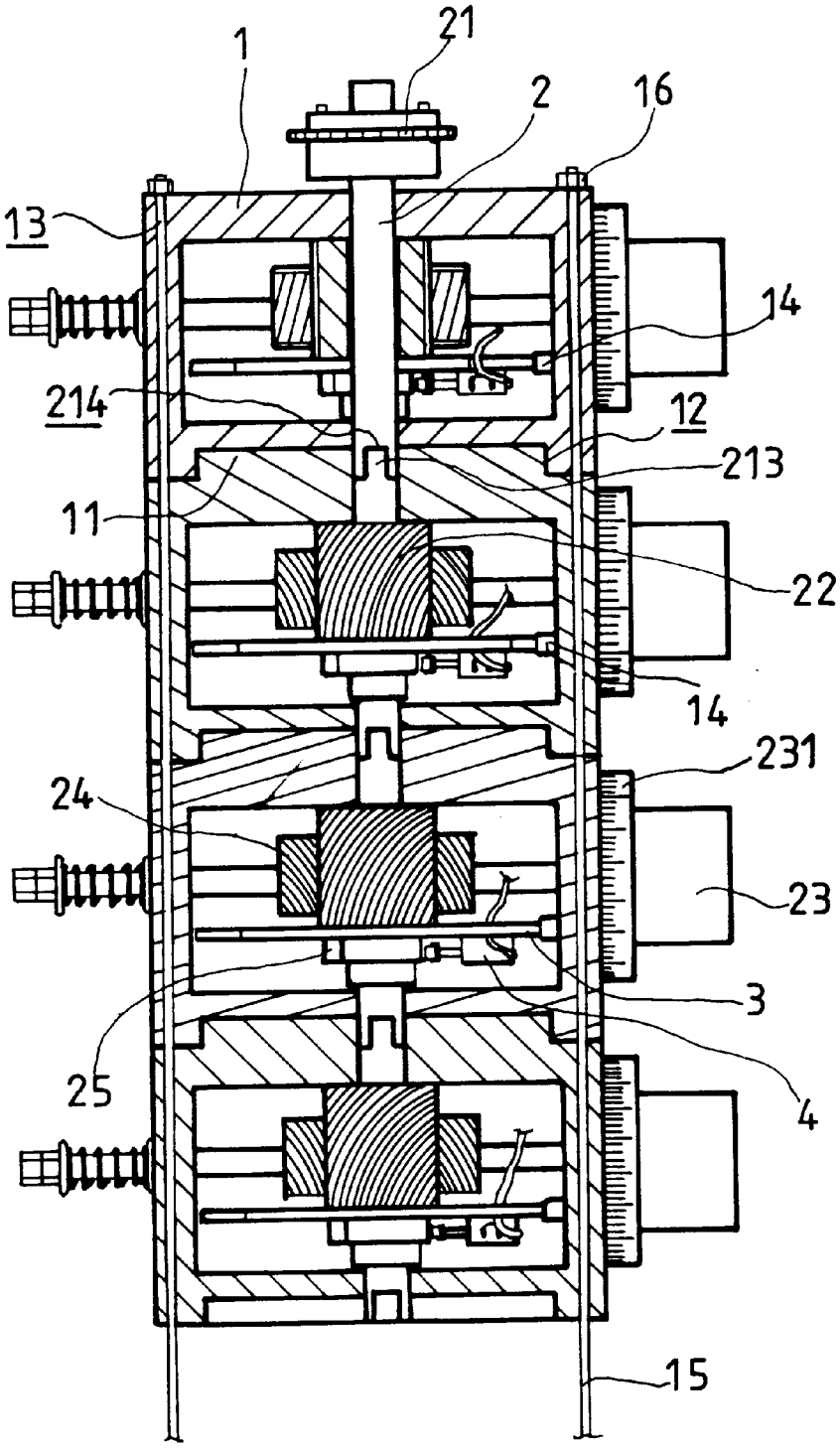
FIG. 3 is a cross-sectional view of the four adjusting unit angle adjusting device of the present invention shown in FIG. 1.

With reference to FIG. 2, wherein two of the adjusting units 1 are shown in an exploded manner to illustrate the inside structure and the connection therebetween, the adjusting unit 1 has a casing defining therein an interior space for accommodating therein an adjusting mechanism which comprises a worm gear 22 rotatably fit over a shaft 2 defining a common rotational axis and a matching worm 24 which is fixed on a spindle 241. The shaft 2 has an expanded section defining a shoulder 26 on which the worm gear 22 is rotatably supported. The casing has a hole on both the upper side wall and lower side wall thereof to rotatably receive the shaft 2 therein. The casing also has a hole formed on each of two opposite lateral side walls thereof to rotatably support the spindle 241, as is more clearly shown in FIG. 3.

The spindle 241 has a manual setting knob 23 fixed to a first end thereof by means of for example a screw 232 for example engaging an inner-threaded hole formed on the spindle end and located outside the casing. The knob 23 allows a user to rotate the worm gear 22 about the shaft 2 by means of the engagement between the worm 24 and the worm gear 22. Preferably, the knob 23 has a dial 231 for indication of the angular position of the worm gear 22 about the shaft 2.

Additionally and preferably, a biasing spring 242 is provided on an opposite second end of the spindle 241 by being supported between an outside surface of the casing and a cap 243 that is fixed to the second end of the spindle 241 so as to provide a biasing force between the casing and the spindle 241 for elimination of undesired backlash or play between the worm 24 and the worm gear 22.

To allow a number of the adjusting units 1 to be stacked over each other in a precisely positioned manner, preferably a projection 11 which is circular in the embodiment illustrated, is formed on the top side of a lower unit 1, while a recess 12 having corresponding shape and size is formed on the bottom side of an upper unit 1 so that when the upper unit 1 is placed over the lower unit 1, they may be precisely aligned with each other.

Bolts or other elongated bar members 15 having threaded section to be tightened by nuts 16 are provided to extend through holes 13 formed on corners of the adjusting units 1 to fix all the units 1 together.

To allow the shafts 2 of all the adjusting units 1 to be drivingly coupled to each other, the upper end of the shaft 2 of the lower unit 1 has a coaxial projection 213 and the lower end of the shaft 2 of the upper unit 1 is provided with a corresponding recess 214 engageable with the projection 213 of the lower shaft 2 so as to form a mechanically driving engagement therebetween.

The upper end of the shaft 2 of the uppermost unit 1 has a sprocket 21 fixed thereto and coupled to the sprocket 71 by means of the chain 8 so that the operation of the motor 6 not only drives the axle 72 to orbit about the shaft 7, but also rotates the shaft 2 with respect to the casings of the units 1 and also with respect to the worms 22 inside the units 1.

Figure 4:
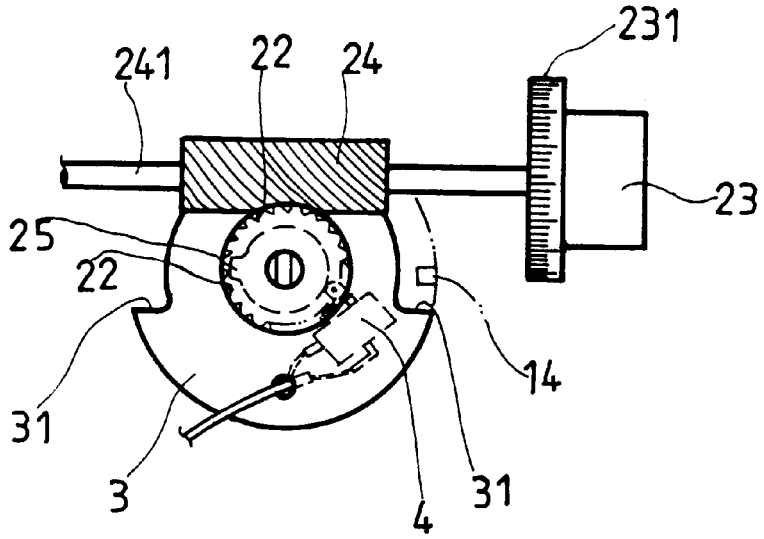
FIGS. 4 and 5 are plan views of the worm-worm gear pair, showing the triggering operation of the switch.
Figure 5:
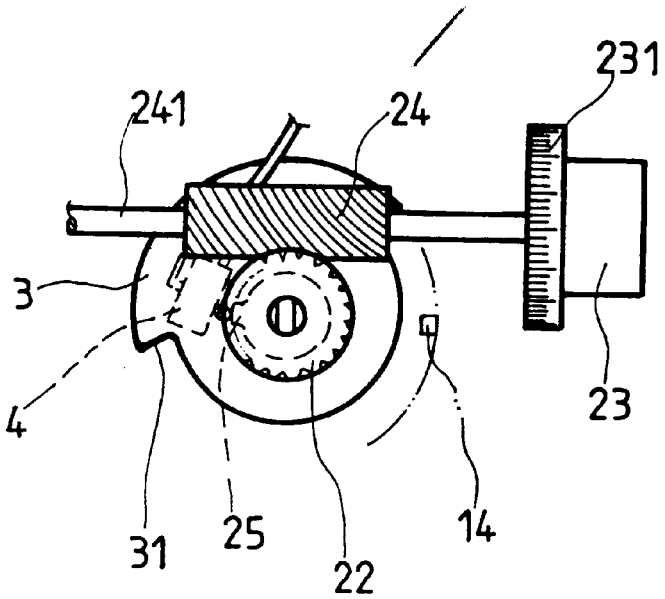

A switch 4 which is electrically connected by means of for example wire to the motor 6 or a controlling device of the motor 6 is attached to the worm 22 to be movable along a circular path about the shaft to a predetermined angular position by means of the rotation of the worm 22 about the shaft 2. The switch 4 is engageable and thus triggered by a projection or triggering member 25 provided on the shaft 2 when the shaft 2 is rotated about the rotational axis and relative to the worm 22 to have the projection 25 reach the predetermined angular position. The predetermined angular position may be manually set by rotating the knob 23 to rotate the worm 22 through the engagement between the worm 24 and the worm gear 22 which moves the switch 4 fixed on the worm 22 to the predetermined position. Once the switch 4 is triggered, the motor 6 is turned off. FIGS. 4 and 5 show such an operation, wherein in FIG. 4, the switch 4 is separated from and thus not triggered by the projection 25, while in FIG. 5, the shaft 2 is rotated relative to the worm 22 to such a position where the projection 25 contacts and thus triggers the switch 4 to turn off the motor 6.

In the embodiment illustrated, and preferably, the projection 25 is integrally formed with the expanded section that defines the shoulder 26 and the expanded section may be a separate part that is individually formed and then fixed to the shaft 2. Alternatively, the expanded section may be integrally formed with the shaft 2, while the projection 25 is additionally attached thereto.

Preferably, the worm 22 has a disk 3 substantially concentrically fixed thereto to be rotatably supported on the shoulder 26 and the switch 4 may be fixed to an underside of the disk 3.

The disk 3 may be provided with two radial steps 31 which are engageable and thus stopped by a projection 14 fixed inside the casing to serve as limits in manually setting the angular position of the switch 4 by rotating the knob 23. The angular distance between the two steps 31 may be arbitrarily selected, for example 270 degrees, which gives the maximum angle range that the adjustment of the angle provided by one adjusting unit 1 may be done.

Figure 6:
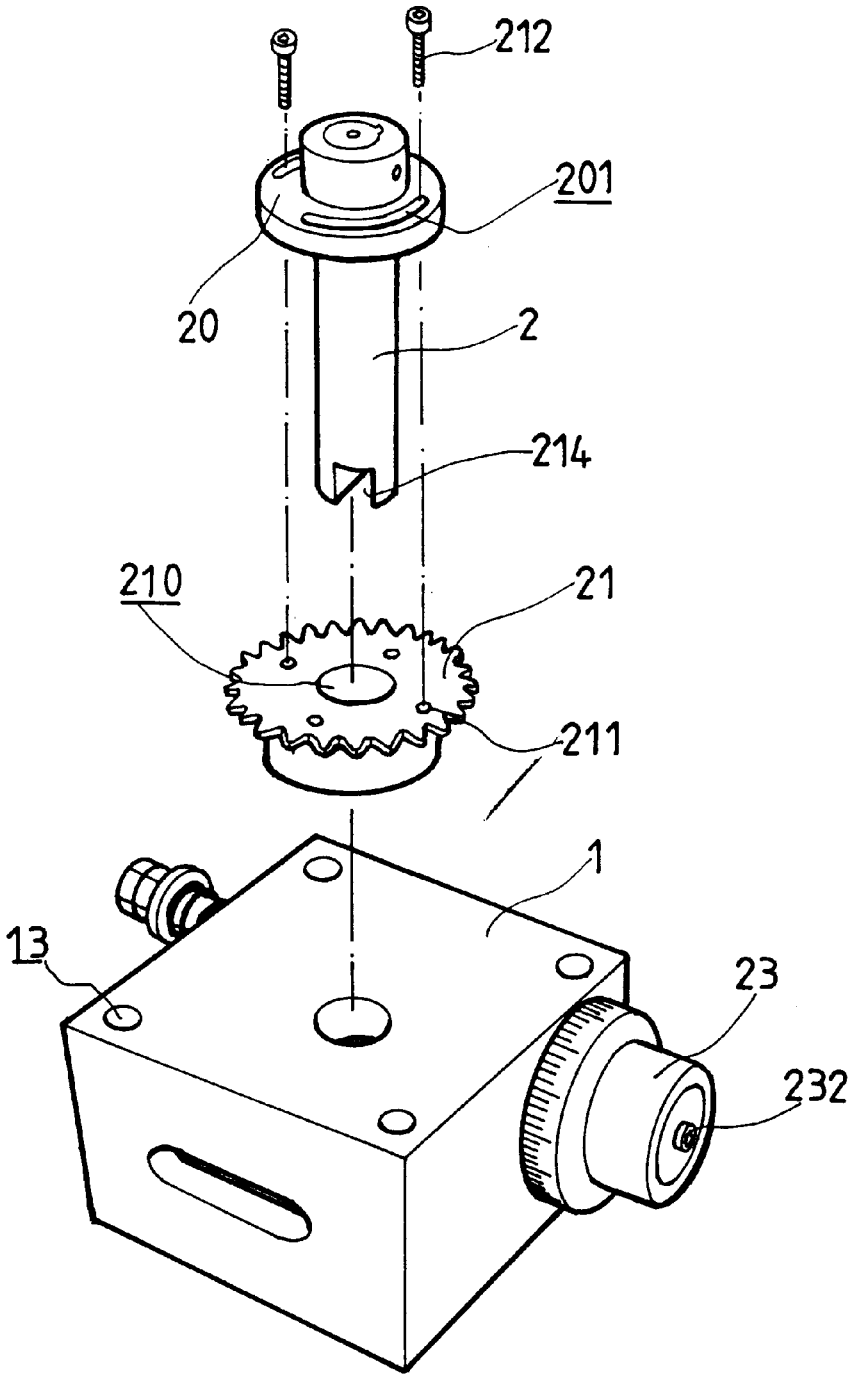
FIG. 6 is an exploded perspective view showing the mounting of the driving sprocket to the shaft of the angle adjusting device.

With reference to FIG. 6, the sprocket 21 is provided with a central bore 210 to receive the shaft 2 of the uppermost one of the adjusting units 1 to extend therethrough. The shaft 2 has a ring 20 fixed thereto on which a plurality of elongated arc slots 201 are formed to receive bolts 212 extending therethrough. The sprocket 21 is also provided with inner-threaded holes 211 for engagement with the bolts 212 so as to fixed the sprocket 21 to the shaft 2. The elongated slots 201 provide means for adjusting relative angular position between the sprocket 21 and the shaft 2.

A user may selectively combine a desired number of adjusting units 1 together by stacking one over the other with the positioning projection 11 of a lower unit fit into the corresponding recess 12 of an upper unit and the shafts 2 drivingly coupled to each other and then individually setting a desired angle for each of the units 1 by using the respective knob 23. Once the motor 6 is actuated to bend a steel bar, the shafts 2 are rotated to have the projections 25 thereof approach the corresponding switches 4. When a first one of the projections 25 engages and triggers the corresponding switch 4, which indicates that a first bend is formed on the steel bar, the motor 6 stops. The user may then move the steel bar to the location where a second bend is to be formed and restarts the motor 6. This makes a second one of the projections 25 approaching the corresponding switch 4 and eventually triggers the switch 4 to stop the motor 6. The second bend is thus completed on the steel bar. The operation may continue on and on until all the desired bends are formed.

The present invention also provides a resetting operation for the steel bar bending apparatus which is done first by returning the axle 721 back to a home position and then release the sprocket 21 by loosening the bolt 212 and release the knob 23 by loosening the bolt 232. The shafts 2 are now free to rotate without being constrained by the chain 8 and the knobs 23 are also free to move back to their home position with respect to the rotation of the shafts 2. The bolts 212 and 232 are then tightened again.

Although a preferred embodiment has been described to illustrate the present invention, it is apparent that changes and modifications in the specifically described embodiment can be carried out without departing from the scope of the invention which is intended to be limited only by the appended claims.

What is claimed is:

1. An angle adjusting device adapted to be incorporated in a steel bar bending apparatus which has a rotation source operable to drive a roller through a mechanical coupling system to bend a steel bar, the angle adjusting device being mechanically coupled to the coupling system to be driven by the rotation source, the angle adjusting device comprising at least two adjusting units comprising:

a casing defining therein an interior space and having a top side wall and an opposite bottom side wall, each having a hole thereon and aligned with each other;

a shaft having a first end and a second respectively rotatably received within the hole on the top side wall and bottom side wall of the casing, the shaft having a triggering member fixed thereon to be rotatable therewith, the shaft being mechanically coupled to and driven by the coupling system of the steel bar bending apparatus for rotating the shaft about a central axis;

a switch disposed in the interior space of the casing and manually movable along a circular path about the shaft, the circular path being such that when the shaft is rotated, the switch is engageable and thus triggered by the triggering member to stop the operation of the rotation source;

a manual knob in mechanical coupling with the switch and located outside the casing to be accessible by a user for moving the switch along the circular path to a predetermined angular position so that when the shaft is driven by the rotation source to rotate the triggering member to the predetermined position, the triggering member engages and triggers the switch to stop the operation of the rotation source, said first adjusting unit having a projection provided on an outside surface of the top side wall and said second adjusting unit having a corresponding recess formed on an outside surface of the bottom side wall for receiving the top side wall projection of the first unit thereon so as to precisely stack the second unit on the first unit;

wherein each of the adjusting units has a plurality of through holes extending from the top side wall to the bottom side wall to receive an elongated bar member extending through all the units and having threaded section to be tightened by a nut in order to fix all the units together.

2. The angle adjusting device as claimed in claim 1, wherein the mechanical coupling between the manual knob and the switch comprises a worm which is fixed on a spindle and a worm gear rotatably fit over and supported on the shaft to allow a relative rotation between the worm gear and the shaft, the worm spindle having a first end extending outside the casing to which the manual knob is releasably fixed, the switch being attached to the worm to be rotatable in unison therewith along the circular path about the shaft so that by rotating the manual knob, the switch is driven to move along the circular path.

3. The angle adjusting device as claimed in claim 2, wherein the knob is releasably fixed to the first end of the spindle by means of a screw engaging an inner-threaded hole on the end of the spindle so as to allow the knob to be readily dismounted from the spindle.

4. The angle adjusting device as claimed in claim 2, wherein the spindle has a second end extending out of the casing and opposite to the first end, a biasing spring being provided between the second end of the spindle and an outer surface of the casing for biasing the spindle in a given direction.

5. The angle adjusting device as claimed in claim 2, wherein the shaft has an expanded section defining a shoulder for supporting the worm thereon.

6. The angle adjusting device as claimed in claim 2, wherein the worm has a disk fixed thereon, the disk having two radial steps which are engageable and thus stopped by a projection disposed in side the casing so as to define two limits in manually rotating the knob to set the angular position of the switch.

7. The angle adjusting device as claimed in claim 1, wherein the rotation source comprises a motor and the switch is electrically connected to the motor to turn off the motor when the switch is triggered by the triggering member.

8. The angle adjusting device as claimed in claim 2, wherein the manual knob comprise a dial for indication of the angular position of the switch.

9. The angle adjusting device as claimed in claim 1, wherein the shaft has an end extending outside the casing with a ring formed thereon, the ring having a plurality of elongated arc slots concentric about the central axis, a rotary driving member being rotatably fit over the end of the shaft to be coupled to the coupling system of the steel bar bending apparatus and having a plurality of inner-threaded holes to allow screws receiving and extending through the arc slots to engage therewith so as to releasably fix the rotary driving member to the shaft and thus couple the shaft to the rotation source.

10. An angle adjusting device adapted to be incorporated in a steel bar bending apparatus which has a rotation source operable to drive a roller through a mechanical coupling system to bend a steel bar, the angle adjusting device being mechanically coupled to the coupling system to be driven by the rotation source, the angle adjusting device comprising at least two adjusting units comprising:

a casing defining therein an interior space and having a top side wall and an opposite bottom side wall, each having a hole thereon and aligned with each other;

a shaft having a first end and a second respectively rotatable received within the hole on the top side wall and bottom side wall of the casing, the shaft having a triggering member fixed thereon to be rotatable therewith, the shaft being mechanically coupled to and driven by the coupling system of the steel bar bending apparatus for rotating the shaft about a central axis;

a switch disposed in the interior space of the casing and manually movable along a circular path about the shaft, the circular path being such that when the shaft is rotated, the switch is engageable and thus triggered by the triggering member to stop the operation of the rotation source;

a manual knob in mechanical coupling with the switch and located outside the casing to be accessible by a user for moving the switch along the circular path to a predetermined angular position so that when the shaft is driven by the rotation source to rotate the triggering member to the predetermined position, the triggering member engages and triggers the switch to stop the operation of the rotation source:

said first adjusting unit having a projection provided on an outside surface of the top side wall and said second adjusting unit having a corresponding recess formed on an outside surface of the bottom side wall for receiving the top side wall projection of the first unit thereon so as to precisely stack the second unit on the first unit;

wherein the shaft of the first unit has a projection formed on the first end thereof and the shaft of the second unit has a recess formed on the second end thereof that faces the first end of the shaft of the first unit for receiving the projection of the shaft of the first unit therein so as to form a driving coupling between the two shafts.

11. The angle adjusting device as claimed in claim 10, wherein the mechanical coupling between the manual knob and the switch comprises a worm which is fixed on a spindle and a worm gear rotatably fit over and supported on the shaft to allow a relative rotation between the worm gear and the shaft, the worm spindle having a first end extending outside the casing to which the manual knob is releasably fixed, the switch being attached to the worm to be rotatable in unison therewith along the circular path about the shaft so that by rotating the manual knob, the switch is driven to move along the circular path.

12. The angle adjusting device as claimed in claim 11, wherein the knob is releasably fixed to the first end of the spindle by means of a screw engaging an inner-threaded hole on the end of the spindle so as to allow the knob to be readily dismounted from the spindle.

13. The angle adjusting device as claimed in claim 11, wherein the spindle has a second end extending out of the casing and opposite to the first end, a biasing spring being provided between the second end of the spindle and an outer surface of the casing for biasing the spindle in a given direction.

14. The angle adjusting device as claimed in claim 11, wherein the shaft has an expanded section defining a shoulder for supporting the worm thereon.

15. The angle adjusting device as claimed in claim 11, wherein the worm has a disk fixed thereon, the disk having two radial steps which are engageable and thus stopped by a projection disposed in side the casing so as to define two limits in manually rotating the knob to set the angular position of the switch.

16. The angle adjusting device as claimed in claim 10, wherein the rotation source comprises a motor and the switch is electrically connected to the motor to turn off the motor when the switch is triggered by the triggering member.

17. The angle adjusting device as claimed in claim 11, wherein the manual knob comprises a dial for indication of the angular position of the switch.

18. The angle adjusting device as claimed in claim 10, wherein the shaft has an end extending outside the casing with a ring formed thereon, the ring having a plurality of elongated arc slots concentric about the central axis, a rotary driving member being rotatably fit over the end of the shaft to be coupled to the coupling system of the steel bar bending apparatus and having a plurality of inner-threaded holes to allow screws receiving and extending through the arc slots to engage therewith so as to releasably fix the rotary driving member to the shaft and thus couple the shaft to the rotation source.

19. An angle adjusting device adapted to be incorporated in a steel bar bending apparatus which has a rotation source operable to drive a roller through a mechanical coupling system to bend a steel bar, the angle adjusting device being mechanically coupled to the coupling system to be driven by the rotation source, the angle adjusting device comprising at least two adjusting units comprising:

a casing defining therein an interior space and having a top side wall and an opposite bottom side wall, each having a hole thereon and aligned with each other;

a shaft having a first end and a second respectively rotatably received within the hole on the top side wall and bottom side wall of the casing, the shaft having a triggering member fixed thereon to be rotatable therewith, the shaft being mechanically coupled to and driven by the coupling system of the steel bar bending apparatus for rotating the shaft about a central axis;

a switch disposed in the interior space of the casing and manually movable along a circular path about the shaft, the circular path being such that when the shaft is rotated, the switch is engageable and thus triggered by the triggering member to stop the operation of the rotation source;

a manual knob in mechanical coupling with the switch and located outside the casing to be accessible by a user for moving the switch along the circular path to a predetermined angular position so that when the shaft is driven by the rotation source to rotate the triggering member to the predetermined position, the triggering member engages and triggers the switch to stop the operation of the rotation source, said first adjusting unit having a projection provided on an outside surface of the top side wall and said second adjusting unit having a corresponding recess formed on an outside surface of the bottom side wall for receiving the top side wall projection of the first unit thereon so as to precisely stack the second unit on the first unit;

wherein each of the adjusting units has a plurality of through holes extending from the top side wall to the bottom side wall to receive an elongated bar member extending through all the units and having threaded section to be tightened by a nut in order to fix all the units together; and wherein the shaft of the first unit has a projection formed on the first end thereof and the shaft of the second unit has a recess formed on the second end thereof that faces the first end of the shaft of the first unit for receiving the projection of the shaft of the first unit therein so as to form a driving coupling between the two shafts.

* * * * *